United States Patent [19]

Saho et al.

[11] 4,445,569

[45] May 1, 1984

[54] SCROLL TYPE LAMINATED HEAT EXCHANGER

[75] Inventors: Norihide Saho; Koji Koibuchi; Kenjiro Kasai; Hiroshi Higaki, all of Kudamatsu, Japan

[73] Assignee: Hitachi, Ltd., Tokyo, Japan

[21] Appl. No.: 357,277

[22] Filed: Mar. 11, 1982

[30] Foreign Application Priority Data

Mar. 20, 1981 [JP] Japan ..... 56-39467

[51] Int. Cl.[3] ..... F28D 7/02

[52] U.S. Cl. ..... 165/165; 165/154

[58] Field of Search ..... 165/164, 165, 166

[56] References Cited

U.S. PATENT DOCUMENTS 2,131,265 9/1938 Bichowsky ..... 165/165
3,848,665 11/1974 Ueruch et al. ..... 165/170

FOREIGN PATENT DOCUMENTS 2306093 9/1974 Fed. Rep. of Germany ..... 165/164
2313650 12/1976 France ..... 165/164
2026677 2/1980 United Kingdom ..... 165/164
0832302 5/1981 U.S.S.R. ..... 165/164

*Primary Examiner*—Albert W. Davis, Jr.
*Assistant Examiner*—John F. McNally
*Attorney, Agent, or Firm*—Antonelli, Terry & Wands

[57] ABSTRACT

The present invention relates to a laminated heat exchanger having a laminated construction consisting of a plurality of perforated heat transfer plates and spacers arranged alternatingly, the spacers defining a plurality of fluid passages between respective adjacent heat transfer plates, so that heat is exchanged between different fluids flowing in different fluid passages through the heat transfer across the heat transfer plates. More specifically, the invention is concerned with a heat exchanger of the type described above, wherein a plurality of separate scroll passages are formed by the spacer, so that local concentration of each fluid in its passage is avoided to remarkably improve the heat transfer efficiency.

5 Claims, 8 Drawing Figures

SCROLL TYPE LAMINATED HEAT EXCHANGER

BACKGROUND OF THE INVENTION

1. Field of the Invention

The present invention relates to a laminated heat exchanger having a plurality of heat transfer plates having a multiplicity of thicknesswise through holes and a plurality of spacers, the heat transfer plates and the spacers are laminated alternatingly such that the spacers define a plurality of fluid passages which extend in the direction of lamination across the heat transfer plates, the adjacent fluid passages being separated from each other by the spacer.

2. Description of the Prior Art

As shown in FIGS. 1 and 2, a typical laminated heat exchanger has a plurality of heat transfer plates 2 each having a multiplicity of holes 1 and spacers 5 and 6, the heat transfer plates 2 and the spacers 5, 6 are laminated alternatingly such that the spacers 5, 6 define passages 3 and 4 for different fluids A and B between which the heat is exchanged. The fluid passages 3 and 4 are formed concentrically with each other. The areas Sa and Sb of the passages for the fluids A and B are given by the following equations (1) and (2), respectively.

$$Sa=\pi/4d_1^2 \quad (1)$$

$$Sb=\pi/4(d_3^2-d_2^2) \quad (2)$$

In designing the heat exchanger, these passages are determined in accordance with the flow rates of the fluids A and B. On the other hand, the heat transfer performance of the heat transfer plate 2 is largely varied by the radial widths of the fluid passages. Namely, the heat transfer efficiency of the heat transfer plate as a fin is improved as the value $d_1/2$ and $(d_3-d_2)/2$ in respective equations are made small. For obtaining larger flow rates of the fluids A and B, it is necessary to preserve sufficiently large areas Sa and Sb of the fluid passages. This, however, decrease the fin efficiency to lower the efficiency of the heat exchanger as a whole.

For increasing the area of the flow passages while limiting the width of each passage, it is considered to employ additional spacer or spacers to form additional concentric passages around the circle of the diameter $d_4$ in FIG. 1, thereby to increase the number of the passages. In such a case, a plurality of passages separated by the spacers are used for each of the fluids A and B, so that there is a fear that each fluid is unevenly distributed to these passages to deteriorate the heat exchanging efficiency. In addition, the headers for each of the fluids A and B has to have a complicated construction to distribute the fluid to a plurality of passages and to collect the same from a plurality of passages.

SUMMARY OF THE INVENTION

Accordingly, an object of the invention is to provide a laminated heat exchanger in which a continuous fluid passage is formed for each fluid between adjacent heat transfer plates separated by a spacer, to obviate any local concentration of each fluid thereby to achieve a higher heat transfer efficiency.

To this end, according to the invention, there is provided a laminated heat exchanger in which a scroll-shaped spacer is used to define a continuous spiral passage for each of a plurality of fluids such that the passages for different fluids are disposed alternatingly as viewed in the radial direction of the heat exchanger.

DESCRIPTION OF THE PREFERRED EMBODIMENTS

Figure 3:
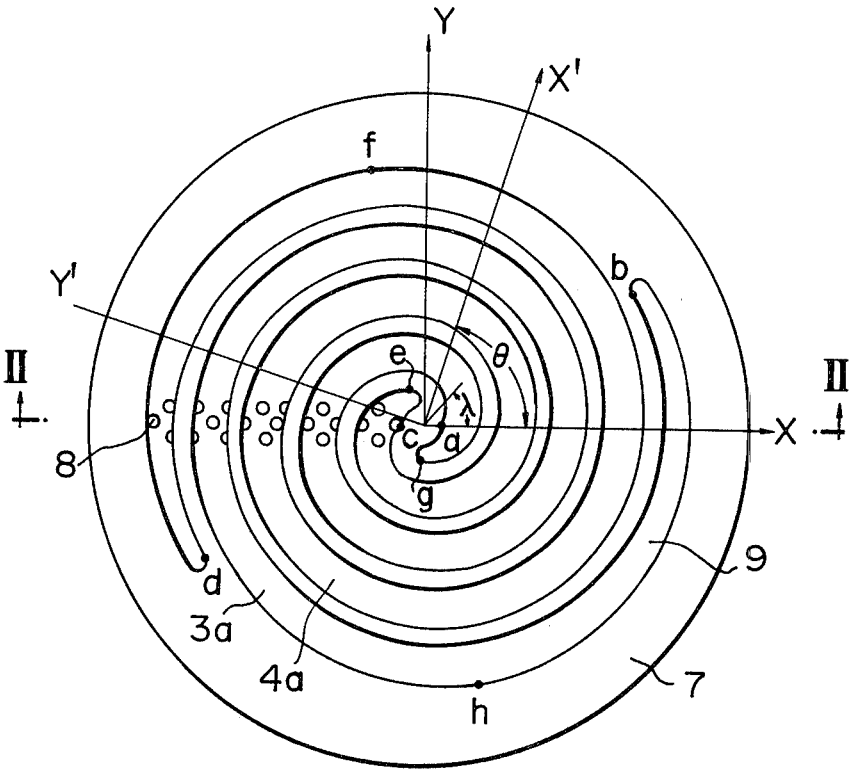
FIG. 3 is a plan view of the heat transfer portion of a scroll type laminated heat exchanger in accordance with an embodiment of the invention.
Figure 4:
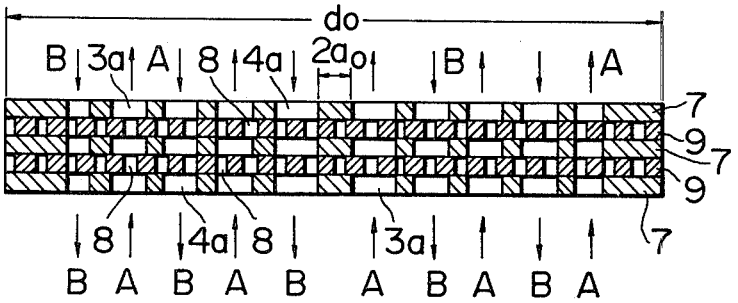
FIG. 4 is a sectional view taken along the line II—II of FIG. 3.

A first embodiment of the invention will be described hereinunder with reference to FIGS. 3 to 5. Referring to FIGS. 3 and 4, the heat transfer portion of the scroll type laminated heat exchanger of the first embodiment has two heat transfer plates and three spacers laminated in layers as illustrated. Each spacer 7 has a scroll-like shape defined by involute curves a→b, c→d, e→f and g→h. The form of the spacer 7 can be expressed by the values of X and Y axes of an X-Y coordinates as follows.

$$X=a_0(\cos\lambda+\lambda\sin\lambda) \quad (3)$$

$$Y=a_0(\sin\lambda-\lambda\cos\lambda) \quad (4)$$

Where, $\lambda$ represents a parameter and $a_0$ represents the radius of the basic circle of the involute. The points a and c are located on the same basic circle, while the points e and g are located on another basic circle.

The curves are in congruity to the curves on an X'-Y' coordinates which is obtained by rotating the X—Y coordinates around a point (0, 0) by an angle $\theta$. Namely, these curves are defined as loci of the point (X', Y') represented by the following equation (5).

$$\begin{pmatrix} X' \\ Y' \end{pmatrix} = \begin{pmatrix} \cos\theta & -\sin\theta \\ \sin\theta & -\cos\theta \end{pmatrix} \begin{pmatrix} X \\ Y \end{pmatrix} \quad (5)$$

Thus, the curve e→f is obtained by rotating the curve a→b by an angle $\theta=\pi$. Similarly, the curve g→h is a curve which is obtained through rotating the curve c→d by an angle $\theta=\pi$. The points b, d, f and h are the points where the involute curves contact the outer circle. Thus, the portions of the spacer extending further from these points have forms of parts of a circle.

If it is necessary to form three or more fluid passages, the angle $\theta$ is selected to be not greater than $\pi$. For instance, for forming three fluid passages, three involute curves are drawn at angles $\theta=0$, $\theta=\pi/3$ and $\sigma=2\pi/3$, respectively, and are connected to three involute curves which are represented by $\theta=\alpha$, $\theta=\pi/3+\alpha$ and $\theta=2\pi/3+\alpha$. By so doing, it is possible to form three grooves, i.e. three fluid passages, in the spacer 7. The Symbol $\alpha$ represents a factor which determines the width of the scroll of the spacer 7, i.e. the width of the partition between a fluid passage and adjacent fluid passages.

Figure 1:
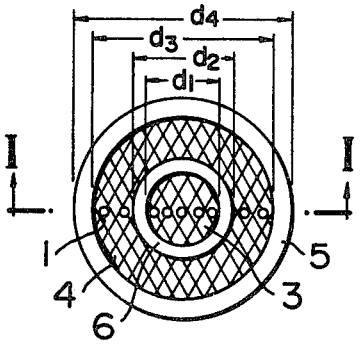
FIG. 1 (PRIOR ART)
FIG. 1 is a plan view of a heat transfer portion of a conventional laminated heat exchanger.
Figure 2:
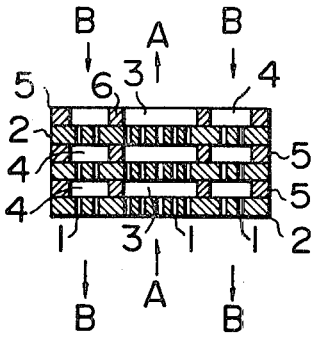
FIG. 2 (PRIOR ART)
FIG. 2 is a sectional view taken along the line I—I of FIG. 1.
Figure 5:
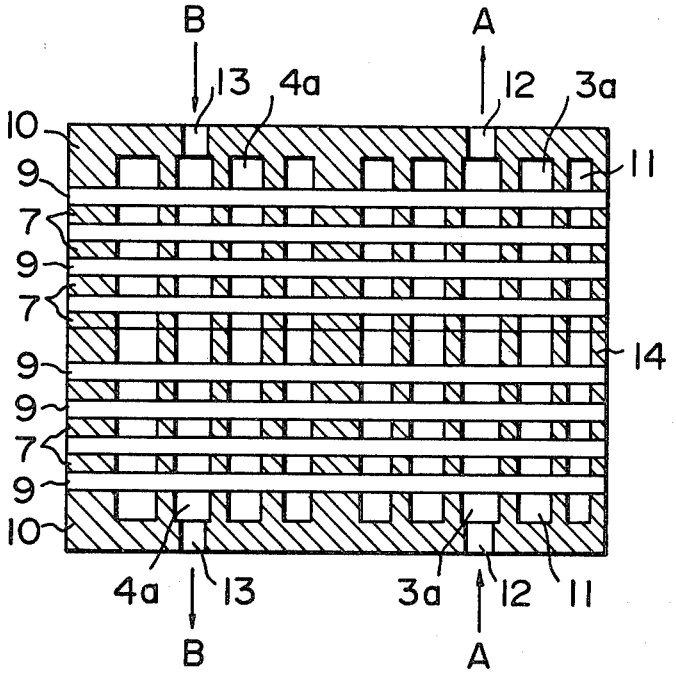
FIG. 5 is a vertical sectional view of the heat exchanger shown in FIG. 3 with headers attached to both ends thereof.

In the embodiment shown in FIGS. 3 thru 5, the ratio of area between the passages for the fluids A and B is 1:1 while the ratio of area between the passages is able to be varied by changing an angle $\theta$. The heat transfer plates 9 made of a metal and having a multiplicity of holes 8 and the spacers 7 are laminated alternatingly in-layers, and the portions of contact between the spacers 7 and the heat transfer plates 9 are bonded metallurgically or by means of an adhesive. The passages 3*a* and 3*b* for the fluids A and B are separated from each other by a spacer 7 on a common heat transfer plate 9, and each passage has a constant width over the entire involute region which does not contact the outer circle.

The spacers 7 are in the same phases with one another in relation to the X and Y axes, so that the fluid passages have constant cross-sectional area also in the direction of flow of the fluids A and B. The heat exchange in this laminated heat exchanger owes to the transfer of heat through the wall of each heat transfer plate in the radial direction of the heat exchanger. Viewing in the radial direction of the heat exchanger, each turn of passage of each fluid is sandwiched between the turns of the passage of the other fluid excepting the outermost portion of the scroll, so that it is possible to increase the fin efficiency of the heat transfer plate 9 over the entire length of the fluid passages 3*a*, 4*a* by a suitable selection of the widths of the flow passages. In addition, by increasing the number of turns of the scroll, it is possible to increase the areas of the flow passages without being accompanied by a reduction in the fin efficiency. It is to be noted also that, since the fluid passage of the same fluid is continuous on each heat transfer plate 9, it is possible to absorb the variance of pressure of the fluid in the passage between adjacent heat-transfer plates 9 over the entire length of each fluid passage. In consequence, the tendency of local concentration of the fluid in the direction of lamination is effectively suppressed to ensure a good heat transfer performance of the heat exchanger. On the other hand, since the outermost peripheral surface of the scroll grooves forms a concentric circle, it is possible to minimize the outside diameter $d_o$ of the spacer 7.

FIG. 5 shows the heat transfer portion shown in FIGS. 3 and 4 with headers attached to both ends thereof. Each header 10 is provided on its one thicknesswise side with scroll grooves 11 of the same size and shape as those in the spacer 7. The grooves 11 in the header 10 communicating with the fluid passages 3*a* and 4*a* are provided with ports 12 and 13, respectively. These ports 12 and 13 constitute the inlet or outlet of the fluids A and B. Namely, by provideding such ports 12 and 13 in each header 10, it is possible to distribute the fluids to all portions of the flow passages in the heat transfer portion. Accordingly, it is possible to remarkably simplify the construction of the header. Referring to FIG. 5, an intermediate flow distribution plate 14 has the same scroll shape as the spacer 7 but its thickness is greater than that of the spacer 7. Therefore, even when a non-uniform pressure distribution is formed in the groove in the spacer 7, the pressure distribution is uniformalized in the groove of the intermediate flow distribution plate 14 having a greater volume, thereby to further eliminate the local concentration of the flow of fluid to ensure a higher heat transfer efficiency.

Figure 6:
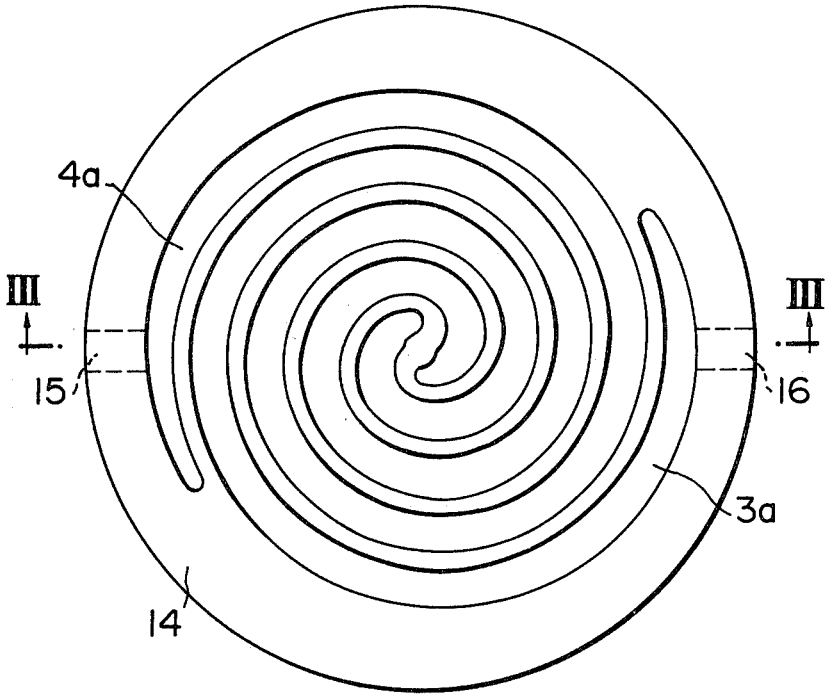
FIG. 6 is a plan view of an intermediate flow distribution plate of a scroll type laminated heat exchanger constructed in accordance with another embodiment of the invention.
Figure 7:
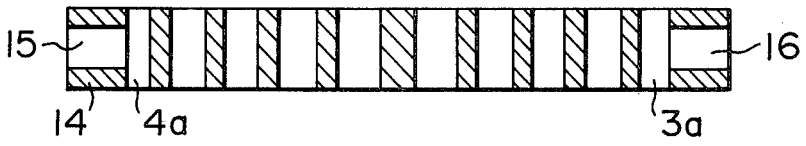
FIG. 7 is a sectional view taken along the line III—III of FIG. 6.

FIGS. 6 and 7 show another embodiment of the invention in which ports 15 and 16 communicating with the outside of the heat exchanger are formed in the outermost peripheral portion of the fluid passages 3*a* and 4*a* formed in the intermediate flow distribution plate 14. In this embodiment, therefore, it is possible to distribute parts of the fluids A and B to the outside of the heat exchanger through this intermediate flow distribution plate 14. This means that the flow rates of the fluids A and B can be increased or decreased at the intermediate portion of the laminated heat exchanger. Thus, the intermediate flow distribution plate 14 in this embodiment serves as a flow distribution header.

Figure 8:
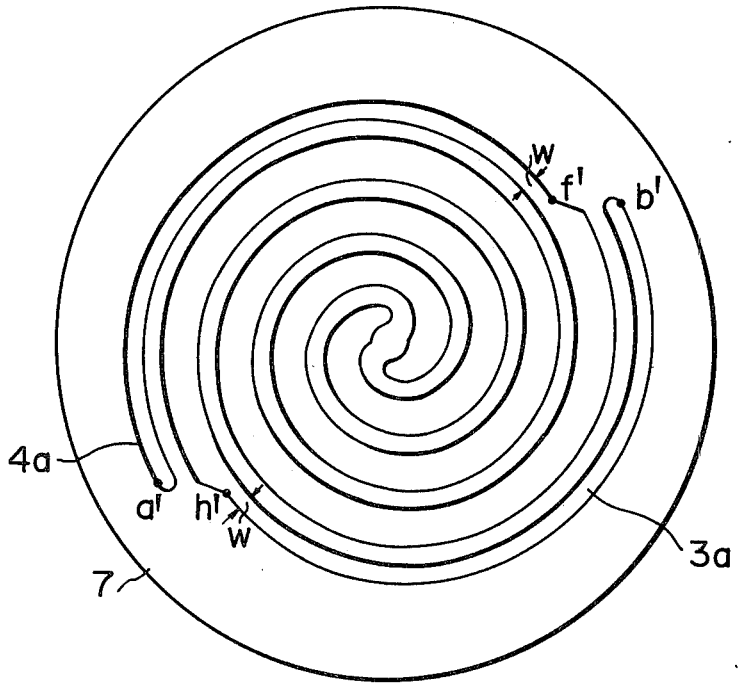
FIG. 8 is a plan view of a spacer incorporated in a scroll type laminated heat exchanger in accordance with still another embodiment.

FIG. 8 shows still another embodiment in which the outermost portions of the fluid passages which neighbour the passage of the other fluid only at their one sides, i.e. the passage portions extending over the curves f'-a' and h'-b', are made to have a width smaller than that of the other portions of the passages which are sandwiched between the passages of the other fluid.

Namely, the curves constituting the outermost peripheral portions of the scroll grooves are determined to preserve a constant width or distance W from the curves defining the inner circumference of the corresponding portions of the scroll grooves, as will be clearly seen from FIG. 8.

According to this embodiment, it is possible to increase the fin efficiency of the outermost peripheral portions of the scroll passages neighbouring the passages of the other fluid only at their one sides can be increased by reducing the width of such portions of the scroll grooves, thereby to further improve the efficiency of the heat exchanger as a whole.

Although the invention has been described through specific embodiments in which the scroll grooves have spiral forms, this is not exclusive and the scroll grooves can have angular or polyginal forms. Namely, the present invention can be carried out using heat transfer plates and spacers having polygonal shape.

As has been described, the invention provides a laminated heat exchanger having a plurality of heat transfer plates and spacers laminated in layers alternatingly to form fluid passages for different fluids in the space between adjacent heat transfer plates, wherein the spacers have scroll-like shape so that a plurality of scroll fluid passages each being continuous in the scrolling direction are formed such that the fluid passages for different fluids neighbour on each other in the radial direction of the scroll.

In consequence, according to the invention, it is possible to eliminate the local concentration of fluid in each passage thereby to remarkably improve the heat transfer performance of the heat exchanger.

What is claimed is:

1. A scroll type laminated heat exchanger comprising a plurality of heat transfer plates having a multiplicity of holes and a plurality of spacers which are laminated alternatingly in layers to form a plurality of fluid passages so that heat is exchanged between different fluids flowing in different fluid passages by the transfer of heat through the heat transfer plates, wherein said spacers define a plurality of separate scroll-shaped fluid passages such that the passages are disposed in a side-by-side relation as viewed in the radial direction.

2. A scroll type laminated heat exchanger as claimed in claim 1, wherein the outermost peripheral portions of said scroll-shaped fluid passages are formed as parts of a circle concentric with the heat exchanger.

3. A scroll type laminated heat exchanger as claimed in claim 1, wherein the outermost peripheral portions of said scroll-shaped fluid passages have a width smaller than that of the other portions of said scroll-shaped fluid passages.

4. A scroll type laminated heat exchanger as claimed in one of claims 1, 2 and 3, characterized by further comprising an intermediate flow distribution plate having scroll-shaped fluid passages of the same size and shape as those of said scroll-shaped passages in said spacers, said intermediate flow distribution plate having a thickness greater than that of said spacers and disposed at the intermediate portion of said laminated heat exchanger.

5. A scroll type laminated heat exchanger as claimed in claim 4, wherein ports communicating with the outside of said heat exchanger are formed at the outermost peripheral portions of said fluid passages in said intermediate flow distribution plate.

* * * * *